United States Patent [19]

Yanez

[11] Patent Number: 4,486,807

[45] Date of Patent: Dec. 4, 1984

[54] NON-LETHAL SELF DEFENSE DEVICE

[76] Inventor: Serge J. Yanez, 1409 Lincoln Way, Auburn, Calif. 95603

[21] Appl. No.: 349,045

[22] Filed: Feb. 16, 1982

[51] Int. Cl.[3] ..... F41B 15/04

[52] U.S. Cl. ..... 361/232; 273/84 ES

[58] Field of Search ..... 361/232; 231/2 E; 273/84 ES; 272/27 N; 128/419 S; 42/1 G

[56] References Cited

U.S. PATENT DOCUMENTS

| | | | |
|---|---|---|---|
| 2,208,852 | 7/1940 | Mongan | 273/84 ES |
| 2,561,122 | 7/1951 | Juergens | 231/2 E |
| 3,885,733 | 5/1975 | Klebold et al. | 361/232 X |
| 3,998,209 | 12/1976 | Macvaugh | 361/232 X |
| 4,162,515 | 7/1979 | Henderson et al. | 361/232 |

*Primary Examiner*—Reinhard J. Eisenzopf
*Attorney, Agent, or Firm*—Leonard Bloom

[57] ABSTRACT

A non-lethal self defense weapon has a housing, a power source within the housing, and a pair of spaced probes projecting from the housing and operatively connected to the power source. A source of light, separately connected to the power source, is mounted on the housing and is oriented to face substantially in the same manner as the probes. Circuitry is provided for synchronizing light pulses with an associated increase in voltage potential at the probes, such that the light pulses temporarily blind an assailant while the probes provide increased voltage pulses.

13 Claims, 7 Drawing Figures

22
14
72
73
20
21
15
16
19
11
10
9
17

NON-LETHAL SELF DEFENSE DEVICE

BACKGROUND OF THE INVENTION

The invention relates specifically to devices for application in self-defense against assault. The invention described herein employs electronic functions to generate intense flashes of visible light, piercing sound and electrical shock. This invention generates the plural said electrical functions in combination and in generally synchronized manner.

The following citations reflect the state of the art of which applicant is aware insofar as they appear to be germane to the patent process.

U.S. Pat. No. 3,998,459 Henderson et al.

U.S. Pat. No. 2,966,621 Voll

U.S. Pat. No. 3,362,711 Larsen et al.

U.S. Pat. No. 2,050,861 Rolston

Of these patents, the patent to Henderson et al. appears to be of great interest since he teaches the use of a tubular housing in the form of a police nightstick or baton in combination with an electrical shock feature. The circuit employs regular batteries to power a solid state power oscillator, whose output voltage is approximately 500 volts AC. Two diode rectifiers are used to convert the alternating current to direct current and charge two capacitors. In order for the voltage to appear on probes, gaps disposed between the diodes and the probes must be suitably dimensioned for the capacitor energy to jump thereacross. This jumping effect produces a pulse-like shock of about 1000–1200 volts DC. It should be noted that given a slight drop in battery voltage, due to repeated use, or gradual depletion of the battery, the capacitor's energy would be discharged to a point where it could not jump the gap. By way of contrast, the instant application is distinguished thereover in many ways, most notably that no gap is employed to produce the pulse effect, instead it is performed electronically for greater reliability.

The patent to Larsen et al. provides a nightstick and shocking device in which the circuit uses conventional batteries to power an oscillator whose output voltage is in the range of 1000–1500 volts AC. This voltage is connected to a series of rings and two small blunt probes for delivering the electrical shock. By way of contrast, the instant application is directed to a mechanism that includes an optically focused flashing light, piercing audio alarm and pulsed electrical shock circuit syncronized in such a suitable manner that with the additional components the probes apply a continuous series of electrical shock pulses in the order of 10,000 volts AC. The pulse duration of the electrical shock and low amperage enables the concentration of the shock in a local area. Thus, a series of controlled shocking pulses is capable of being experienced by an attacker, and at regular intervals, for the attendant benefits and functions.

The remaining references show the state of the art further.

Thus the use of individual devices which produce electrical shock, light or sound is known and can be found in combinations using light and sound or electrical shock and light. However no previous device is known wherein pulsed high voltage electrical shock, intense flashing light and continuous piercing sound have been collectively embodied, operated in combination and generally synchronized. It will be shown that the generally synchronized presentation of electrical shock, intense flashing light, and piercing sound provide an effective combination in attacking the senses of the feeling, sight, and hearing and as such would be effective in creating apprehension, confusion and fear of detection on the part of the assailant. In one such configuration the use of tear gas may be used in place of the piercing sound or one of the other electronic functions as an alternative deterrent or may be further included.

SUMMARY AND OBJECTS OF THE INVENTION

There is described herein a device suitable for use by persons for self-defense against assault. This invention embodies an improved method and means of generating AC electrical shock voltage while in combination with a method of generating intense flashing visible light and continuous piercing sound. It is contemplated that this invention will be useful to police and civilian personnel, and as such will require three distinct geometric forms of housing the electronic circuit components in order to satisfy the peculiar and special requirements of the policeman, security guard and civilian. To this extent three forms of housings are presented herein, different only in appearance and in the relative positioning of the electronic components housed within each form, however identical in electrical functions and performance.

A principle feature and object of the invention is the utilization of known circuit components, circuit arrangements and technology to provide a new and more effective method of personal defense against assault by electronically generating, in combination and generally synchronized fashion, long duration flashes of intense visible light which are distracting, piercing sound and electrical shock, wherein the flashing light and continuous sound provide a means of summoning attention and assistance and the electrical shock providing a means for delivering, a less-than-lethal, stinging pain in the event the assailant attempts to secure physical control.

An additional feature and object of the invention is the improved method and means of generating electrical shock while simultaneously extending the duration of the flash produced by a xenon lamp through the means of inductance. Whereas heretofore known devices only generate and deliver a high voltage, the instant invention uses an improved method and means to generate and deliver pulsed electrical shock utilizing a common pair of conductive probes, wherein the shock voltage is generally 10 KV AC.

Another feature and object of the invention is the utilization of two pointed, electrically conductive probes, which heretofore in other known electrical shocking devices are blunt, such pointed probes need not rely upon contacting exposed skin for means of delivering electrical shock and may be further used to penetrate heavy clothing so as to deliver electrical shock to the heretofore protected areas of the human body.

A further feature and object of the invention is the utilization of three distinct forms of housings which are suitable for respectively storing in purses, pockets or on a policeman's belt loop wherein the police housing is formed similiar to a policeman's stick and may be further used as a club in the method peculiar and special to the policeman. Furthermore said forms of housing are constructed preferably of high impact plastic so as to withstand various forms of reasonable abuse in the course of their use and that they further exhibit in their various forms, those distinct features which serve to provide a secure and firm holding of the invention.

Yet another feature and object of the invention is the use of a conventional power oscillator to generate substantially 350 VDC to operate a conventional xenon arc lamp circuit arrangement and wherein, by operatively inserting to said circuit arrangement a step up transformer whose primary couples with said circuit arrangement, a means is provided for generating a high voltage of 10,000 VAC on the secondary while simultaneously extending the flash duration of xenon lamp so as to more effectively yet temporarily blind the assailant.

These object and other related features and objects of this invention will be better understood by considering the information provided in the accompanying specification taken in conjunction with the drawings herein.

DETAILED DESCRIPTION OF THE PREFERRED EMBODIMENT OF THE INVENTION

Figures 1, 5, 6:
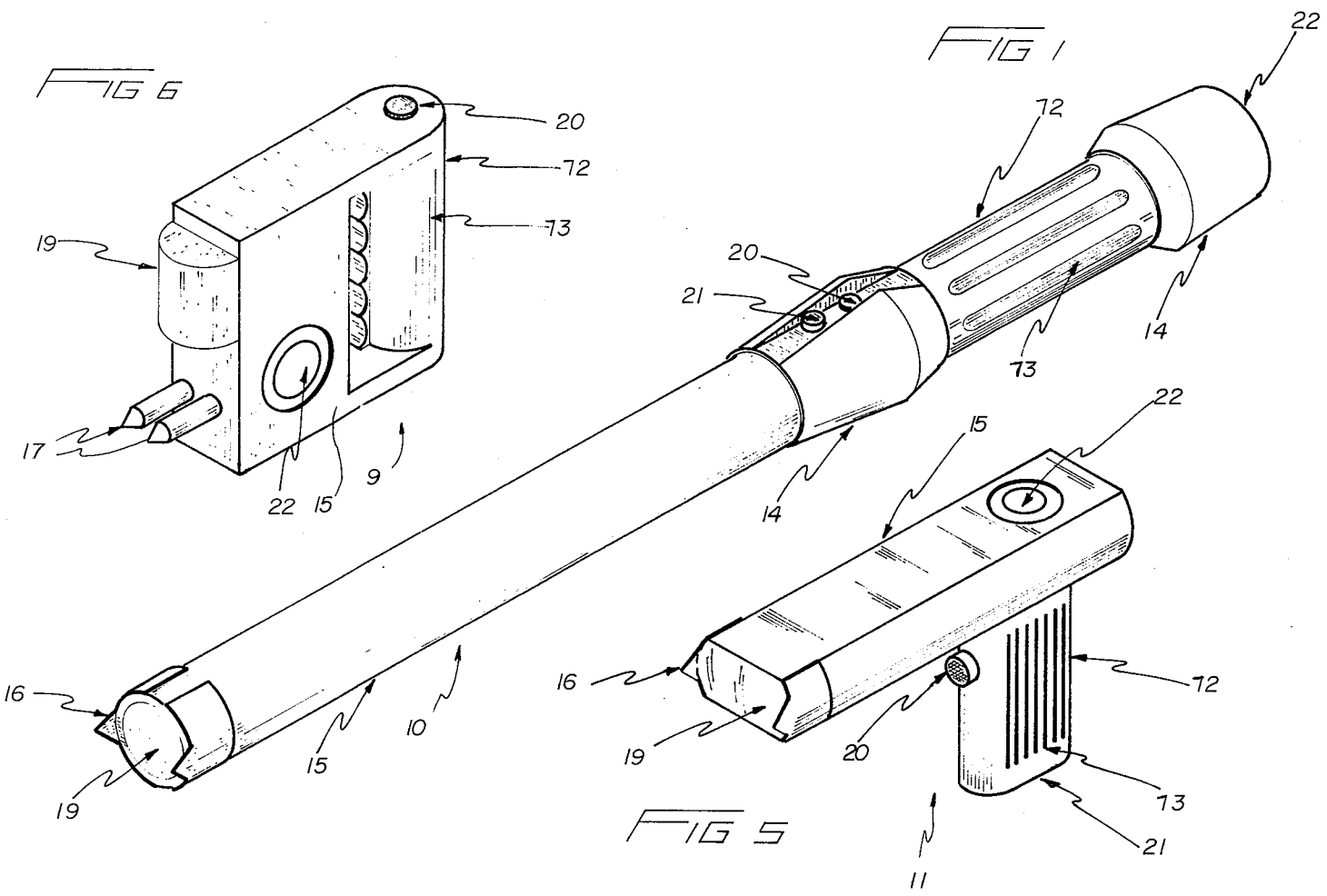
FIG. 1 is a perspective view of one form of the non-lethal weapon according to the instant invention.
FIG. 5 is a perspective view of the gun type of FIG. 4.
FIG. 6 is a perspective view of a third form of the invention.

Referring now to the drawings wherein like reference numerals refer to like parts, there is illustrated in FIGS. 1, 5 and 6, the three distinct housing forms used in the embodiment of the invention: a box-like housing form generally designated by the number 9, a tubular housing form generally designated by the number 10 and the gun-like housing form generally designated by the number 11.

As seen in FIG. 1, the tubular housing form 10 exhibits a handle section 72 containing a series of longitudinal grooves 73 to serve in providing a firm grasp of the handle section; also exhibited are two enlarged sections 14 for and aft of the handle section, whose circumference, contouring and length may be of such dimensions as to provide restraint to longitudinal movement of the hand along the handle. A forward section 15 in combination with the handle section 72 form a rigid hollow tube preferably constructed of high impact plastic. The tubular housing 10 may be provided in lengths of 12 inches to 30 inches in such increments of length as to serve the specifications of the user. Positioned within said housing form 10 is an arrangement of optical components, electronic circuit components and a battery serving as the low voltage power source to be described.

Mechanically attached to said housing form 10, and removable for replacement are two electrically conductive probes 16. Clearly several modifications and variations of the probe construction are possible such as the arrowlike angular projections in probe 16 or the pointed dowels in probe 17 (FIG. 6), and the probes need not be equidistant or diametrically opposed in position as shown so as to effectively function in the penetration of clothing and delivery of electrical shock. Recessed also in the forward end of said housing 10 near the probes is a single element optical refractive lens 19 so arranged with optical components positioned in the housing 10 as to concentrate emitted light. Located conveniently in the enlargement 14 forward of handle section 72 a switch 20 is provided for operating the device and a receptacle jack 21 is disposed for the introduction of suitable power for recharging the battery positioned within handle section 72. Also positioned within the handle section 72 aft portion is an electro-mechanical audio alarm 22, of such construction as to be mechanically secured, yet removable when so required from within handle section 72. Such a removable arrangement serves to provide a means for interchanging the said audio alarm 22 with a tear gas dispenser (not shown).

Electrical jack 21 which is connected directly to battery 18 (FIG. 2) by two wires serves as a receptacle for receiving low voltage DC, suitable for recharging battery 18. An optical reflector 13 may be of any suitable plastic material capable of providing a metalized reflective surface, much like that of a headlight lamp and may be constructed be such economical methods so as to provide a highly efficient spherical or parabolic reflector. A refractive lens 19 shall be employed to further collect and focus the light reflected by the optical reflector 13. The said housing shall be constructed from a suitable plastic material capable of withstanding repeated physical blows and other forms of normal abuse. A filler material 40 can be employed in the tubular housing version to position the electronics module.

Figure 3:
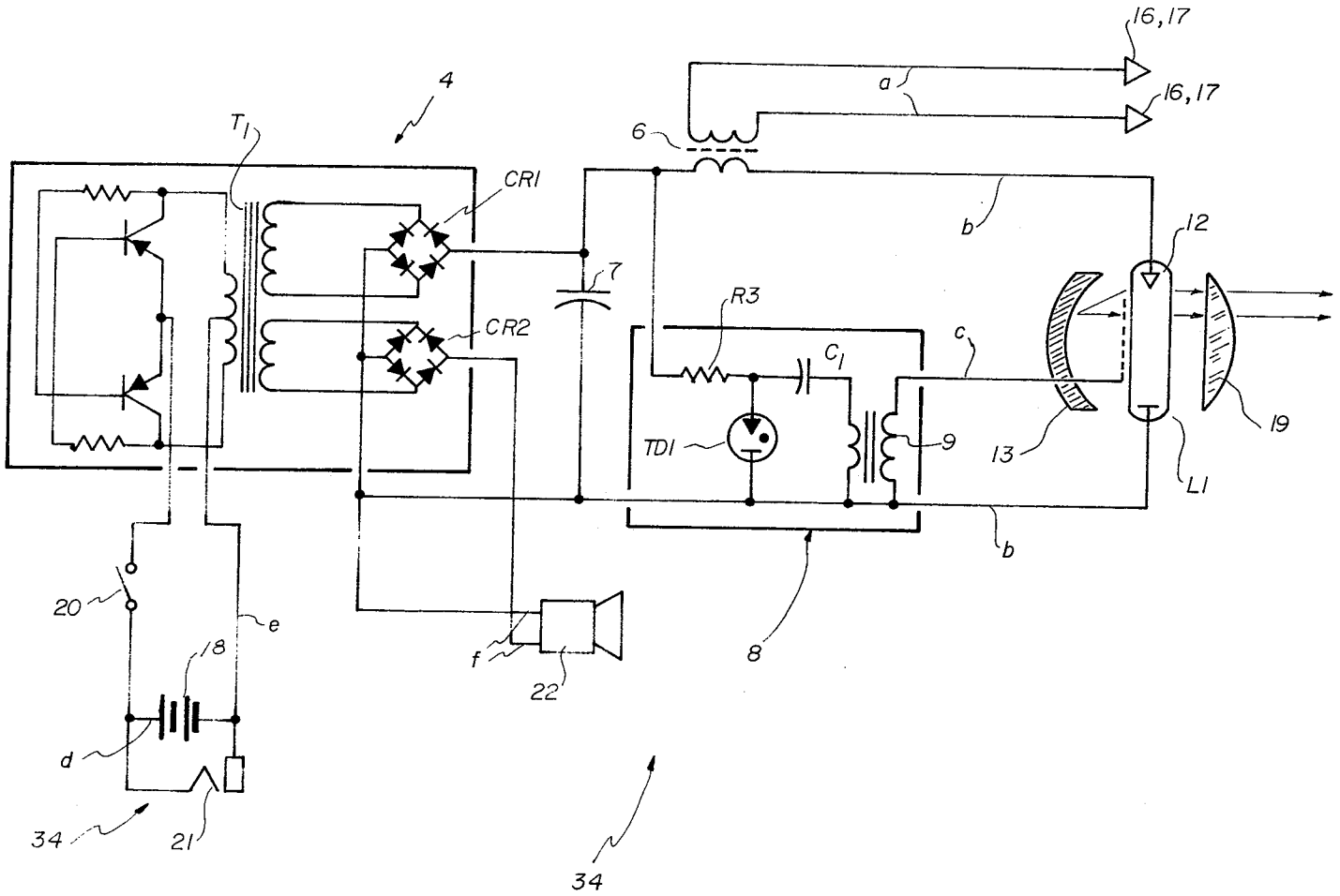
FIG. 3 is a schematic diagram of the electronic circuit arrangement of components housed within the housing forms.
Figure 4:
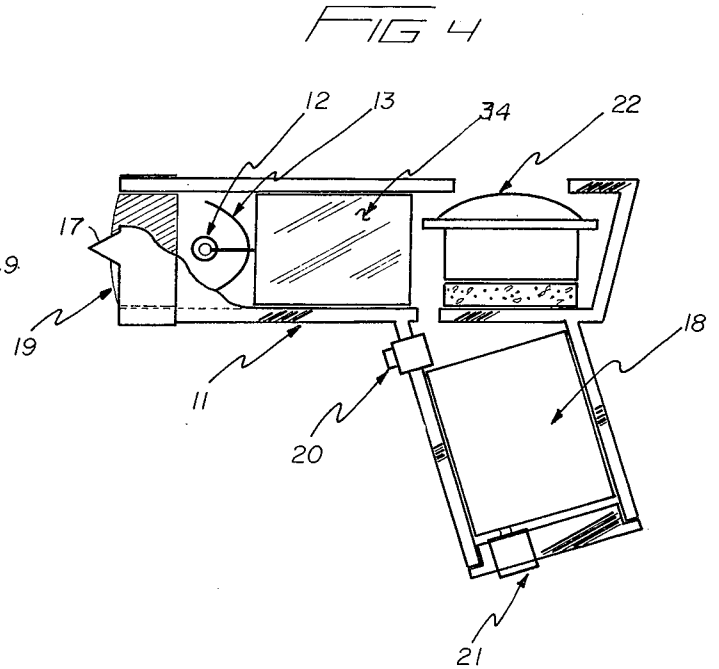
FIG. 4 is a longitudinal sectional view of the gun like non-lethal device.
Figure 7:
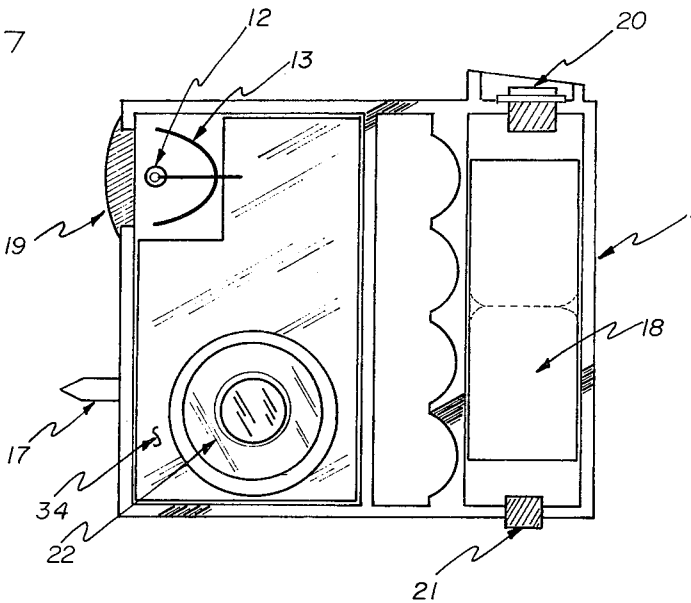
FIG. 7 is a longitudinal sectional view of FIG. 6.
Figure 2:
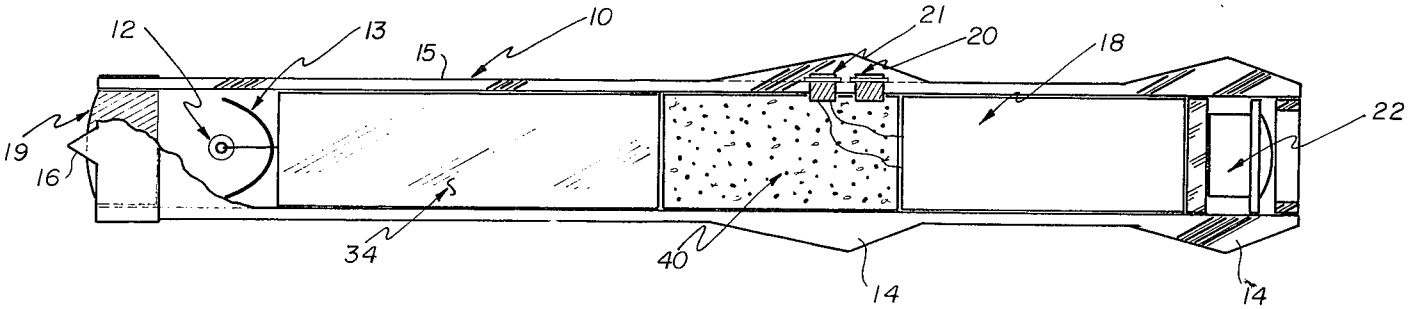
FIG. 2 is a longitudinal sectional view of the tubular, police baton like non-lethal device.

Shown in FIGS. 2, 4 and 7 are cutaway views of the three forms of housings: box like 9, gun like 11, and tubular 10, wherein the various electronics components are positioned. It is to be appreciated that because of the geometric forms of housings to be used, the configuration of the electronic module 34 will also be different so as to conform to the space available within the housing. The electronics module 34 shall consist of an internal arrangement of circuit components attached to a printed circuit board, and further encapsulated in electronics module 34 is a number of wires as per FIG. 3 external the printed circuit to perform the following functions:

a. two wires for the transmission of 10 KV AC electrical shock voltage which are connected directly to the pair of electrical conductives probes 16, 17.
b. two wires for the transmission of positive and negative 350 volts D.C. which are connected directly to the anode and cathode of the xenon arc lamp 12 which is disposed behind lens 19 and forward reflector 13.
c. one wire for the transmission of generally 5 KV AC which is connected directly to the surface of the xenon arc lamp 12 tube surface.
d. one wire for receiving positive low voltage D.C. power from battery 18 and which is connected directly to one terminal of trigger switch 20. Also attached to switch 20 on the second terminal an additional wire is connected directly to battery 18.
e. one wire for receiving negative low voltage D.C. power from battery 18 and which is connected directly to battery 18.
f. two wires for providing 30 volts D.C. to horn 22.

Shown in FIG. 3, is the electrical diagram of the invention. Low voltage DC power is provided by a rechargable battery 18 of commercial variety and whose power is directly applied to a power oscillator 4 upon closure of switch 20. The oscillator 4 becomes a DC to DC converter with the inclusion of bridge rectifiers CR1 and CR2 and may embody any arrangement of electronic circuit components, to the extent necessary to convert low voltage DC to either half or full-wave rectified DC high voltages whose potential values are generally 350 and 30 volts, so as to operate a variety of commercially available xenon arc lamps 12 piezo-electric audio alarm 22. Inductor 6 is a step-up transformer whose primary winding in conjunction with storage capacitor 7 resonate to the frequency out of the DC to DC converter's output voltage. The arrangement of inductor 6 and capacitor 7 provide the function of filtering the rectified output voltage of the converter, storing energy for operation of arc lamp 12 and during the arc discharge of lamp 12, induce across the secondary coil of inductor 6, a high voltage of approximately 10 KV AC which is connected to conductive probes 16, 17. Xenon arc lamp 12 is connected directly to storage capacitor 7. A free running triggering circuit 8 may embody any arrangement of electronic circuit components to the extent necessary to induce a voltage across the primary of transformer 9, and such that both said transformers, operating in combination and generally synchronized, provide high voltage pulses at a rate of generally 3 per second. Transformer 9 shall generally provide a voltage of 5 KV AC as means for inducing the arc lamp 12 to discharge, and in so doing discharges capacitor 7 through transformer 6. The inductive reactance of transformer 6 then functions to lengthen the discharge of capacitor 7 for a means of extending the duration of the xenon lamp 12 flash. Optical reflector 13 and refractive lens 19 function in combination with arc lamp 12 as a means of concentrating the visible light produced by the lamp.

The secondary windings of transformer 6 and transformer 9 operate in combination and in arrangement such that the voltage provided by transformer 6 appears across probes 16, 17 only during the flashing of xenon lamp 12.

Thus, the output of transformer 6 is generally 1000 volts AC initially, and this voltage is then applied to the conductive probes.

In an alternative embodiment, the trigger generator 8 would function as follows. The generator consists of a free running oscillator formed from resistors R3 and capacitor C1 and trigger diode TD1. These components serve to generate a series of pulses which are used to produce current flow in the primary of transformer 9 which in turn produces 5 KV high voltage pulses used to ionize the xenon lamp 12. It should be noted that the close placement and judicious distance of the two probes 16, 17 serve as an inherent capacitive system in the probe network.

Thus, operation starts with the energization of the triggering circuit. Capacitor 7 reaches full charge first and when capacitor C1 reaches full charge, it turns on trigger diode TD1. This trigger diode TD1 acts like a switch which is then closed providing a current through a primary side of transformer 9. Thus, the residual potential difference that exists on the arc lamp 12 as exhibited by wires b, is substantially increased by the effects of the transformer coil 6 on the xenon lamp grid causing a greater elongated intensity discharge in the lamp 12 magnified by the lens 19 and the reflector 13, which operates in concert with the boost provided by transformer 6 across the wires "a" effecting the probes 16, 17. Thus, while transformer 6 serves to provide a base voltage potential difference across the opposed probes 16, 17, the transformer 9 operates in concert therewith to provide voltage surges corresponding to intense flashings of the light. It has been found that the temporary blindness associated with a powerful light pulse as caused by the xenon lamp, when coupled with an additional voltage to the attacker is beneficial for avoiding further confrontation.

Moreover, having thus described the invention, it should be appreciated whereas only three external configurations of the device have been set forth hereinabove, it is believed that multitudenous geometrical configuration as well as circuits are viewed as being within the scope of the structure according to the instant application as set forth hereinabove and as defined hereinbelow by the claims.

What is claimed is:

1. A non-lethal self defense weapon comprising, in combination:

a housing, a power source within said housing, a pair of spaced probes operatively connected to said power source on said housing, a source of light operatively connected to said power source and oriented to face substantially in the same manner as said probes, first means for delivering a series of electrical pulses to energize said light source to temporarily blind an assailant, and second means for delivering a series of relatively high-voltage electrical pulses to said probes in substantial synchronization with the pulsed energization of said light source.

2. The device of claim 1, wherein said weapon includes a further form of deterrent.

3. The device of claim 2, wherein said source of light includes a reflector for directing the light in one direction, and a focusing lens overlying said source and disposed on said housing.

4. The device of claim 3, wherein said first and second means includes a trigger generator disposed in an associated circuit, said circuit including a power oscillator connected to said power source, means for rectifying output from said power oscillator to thereby form a D.C. to D.C. convertor and having greater voltage output than input, said output providing a base voltage across said source of light and serving to provide a base voltage differential across said probes.

5. The device of claim 4, wherein said further form of deterrent comprises an audible alarm operatively connected to said power source.

6. A non-lethal self defense weapon comprising, in combination:

a housing, a power source within said housing, a pair of spaced probes operatively connected to said power source on said housing, a source of light operatively connected to said power source oriented to face in the same manner as said probes, and means for synchronizing a light pulse with an associated increase in voltage potential at said probes whereby said light pulse temporarily blinds an assailant, and said probes deliver an increased voltage, wherein said weapon includes a further form of deterrent, wherein said source of light includes a reflector for directing the light in one direction, and a focusing lens overlying said source and disposed on said housing, wherein said means for synchronizing said light source and probe voltage includes a trigger generator disposed in an associated circuit, said circuit including a power oscillator connected to said power source, means for rectifying output from said power oscillator to thereby form a DC to DC convertor and having greater voltage output than input, said output providing base voltage across said source of light and serving to provide a base voltage differential across said probes, wherein said trigger generator includes means for first providing a voltage surge across a grid in said source of light, thereby discharging said light source, and thereafter increasing said base voltage differential across said probes.

7. A non-lethal self defense weapon comprising, in combination:

a housing, a power source within said housing, a pair of spaced probes operatively connected to said power source oriented to face in the same manner as said probes, and means for synchronizing a light pulse with an associated increase in voltage potential at said probes whereby said light pulse temporarily blinds an assailant, and said probes deliver an increased voltage, wherein said weapon includes a further form of deterrent, wherein said source of light includes a reflector for directing the light in one direction, and a focusing lens overlying said source and disposed on said housing, wherein said means for synchronizing said light source and probe voltage includes a trigger generator disposed in an associated circuit, said circuit including a power oscillator connected to said power source, means for rectifying output from said power oscillator to thereby form a DC to DC convertor and having greater voltage output than input, said output providing a base voltage across said source of light and serving to provide a base voltage differential across said probes, wherein said further form of deterrent comprises an audible alarm operatively connected to said power source, wherein said trigger generator includes a first transformer having a primary winding and further having a secondary winding connected to said light source, a trigger diode adapted to energize said secondary by serving as a gate for said primary, and means for closing said gate.

8. The device of claim 7, wherein said means for closing said gate includes a capacitive resistive network.

9. The device of claim 8, wherein said light source is a xenon lamp.

10. The device of claim 9, wherein said power source includes recharging means and an actuating switch.

11. In a hand-held non-lethal self-defense device for use against an assailant or other subject, wherein a housing has a D.C. voltage source, means for converting the D.C. voltage to a higher D.C. voltage, a storage capacitor connected to the converting means, and a pair of spaced conducting means carried by the housing and energized upon discharge of the capacitor, the improvement which comprises a lamp means carried by the housing, a step-up transformer having a primary winding connected in series between the capacitor and the lamp means and further having a secondary winding connected across the spaced conducting means, and a triggering circuit connected across the capacitor and including a pulse transformer connected to the lamp means, wherein the pulse transformer provides a pulsed voltage to induce the lamp means to discharge, thereby providing a series of blinding flashes, wherein the inductive reactance of the primary winding of the step-up transformer tends to lengthen the discharge of the capacitor and to extend the duration of the flashes, and wherein during the discharge of the lamp means, a high voltage is induced across the secondary of the step-up transformer, the arrangement being such that both transformers operate in substantial synchronism to supply relatively high-voltage pulses to the conducting means and to the lamp means, respectively.

12. In a hand-held non-lethal self-defense device for use against an assailant or other subject, wherein a housing has a pair of spaced conductive probes and further has a lamp means in juxtaposition to the probes, the improvement which comprises means in the housing for energizing the lamp means with a series of relatively high-voltage pulses for causing the lamp means to discharge to produce a series of blinding flashes to temporarily disable the assailant's vision, and means for simultaneously generating a series of relatively high-voltage pulses across the conductive probes in substantial synchronism with the blinding flashes and of sufficient magnitude for penetrating areas of the assailant's body which are protected by clothing, yet without risk of cardiac arrest.

13. The improvement of claim 12, wherein the pulses for energizing the lamp means have a voltage of approximately 5 K.V. A.C., and wherein the pulses across the conductive probes have a voltage of approximately 10 K.V. A.C.

* * * * *